US006457182B1

(12) United States Patent
Szczesuil et al.

(10) Patent No.: US 6,457,182 B1
(45) Date of Patent: Oct. 1, 2002

(54) PROTECTIVE GLOVE

(75) Inventors: Steve Szczesuil, Framingham; Debra McLean, Whitinsville, both of MA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/877,279

(22) Filed: Jun. 8, 2001

(51) Int. Cl.[7] ..... A41D 19/00
(52) U.S. Cl. ..... 2/161.6; 2/16; 2/167
(58) Field of Search ..... 2/16, 20, 159, 2/161.6, 161.7, 162, 163, 164, 167, 169; 601/40; 602/21

(56) References Cited

U.S. PATENT DOCUMENTS

| | | | | | |
|---|---|---|---|---|---|
| 2,864,091 | A | | 12/1958 | Schneider | 2/2.5 |
| 3,386,104 | A | | 6/1968 | Casey | 2/161 |
| 3,916,448 | A | * | 11/1975 | Hamel | 2/167 |
| 4,742,578 | A | | 5/1988 | Seid | 2/2.5 |
| 4,750,218 | A | * | 6/1988 | Ziegler | 2/159 |
| 4,843,650 | A | * | 7/1989 | Kangas et al. | 2/159 |
| 5,054,126 | A | * | 10/1991 | Rivkin | 2/162 |
| 5,070,543 | A | | 12/1991 | Beck | 2/163 |
| 5,187,815 | A | | 2/1993 | Stern et al. | 2/161 |
| 5,231,700 | A | | 8/1993 | Cutshall | 2/161.7 |
| 5,894,602 | A | * | 4/1999 | Smith et al. | 2/159 |
| 5,974,588 | A | * | 11/1999 | Furman | 2/159 |

* cited by examiner

*Primary Examiner*—Danny Worrell
*Assistant Examiner*—Gary L. Welch
(74) *Attorney, Agent, or Firm*—Vincent J. Ranucci

(57) ABSTRACT

A protective glove for a human hand, the glove including five finger portions, and a finger tip portion of a plurality of the finger portions comprising wire mesh.

39 Claims, 5 Drawing Sheets

PROTECTIVE GLOVE

STATEMENT OF GOVERNMENT INTEREST

The invention described herein may be manufactured and used by and for the Government of the United States of America for Governmental purposes without the payment of any royalties thereon.

BACKGROUND OF THE INVENTION

1. Field of the Invention

The invention relates to protective gloves and is directed more particularly to gloves for use in "frisk" and "pat-down" searches, and the like.

2. Description of the Prior Art

It is known to use gloves in frisk and pat-down operations, to provide protection against blood borne pathogens that cause disease, such as HIV, hepatitis, tuberculosis, malaria, and the like. It is further known to use such gloves in correction facilities for searches of persons and cells, and the like. Typically, the gloves used are of thin stretchy latex, nitrite, nitrite coated material, vinyl, or vinyl coated material. The gloves are not resistant to needle puncture, not sufficiently durable for continuous pat-down use because of poor abrasion resistance, and not resistant to cuts and tears. In an effort to improve upon these characteristics, gloves of the same type have been made durable and more protective, but at the. cost of stiffness and bulkiness, so much so that tactility is lost or at least greatly diminished. That is, the wearer lacks good perception or feel of an object being touched.

Thus, there is a need for a frisk and pat-down glove which is resistant to needle punctures and cuts, but with good tactile characteristics.

SUMMARY OF THE INVENTION

Accordingly, an object of the invention is to provide a protective glove for frisk and pat-down searches, the glove providing protection to the wearer against punctures and cuts, but which is flexible, durable, form-fitting, and affords excellent tactility.

With the above and other objects in view, as will hereinafter appear, a feature of the invention is the provision of a protective glove for a human hand, the glove including five finger portions, and a finger tip portion of one or more of the finger portions, the finger tip portions comprising wire mesh.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
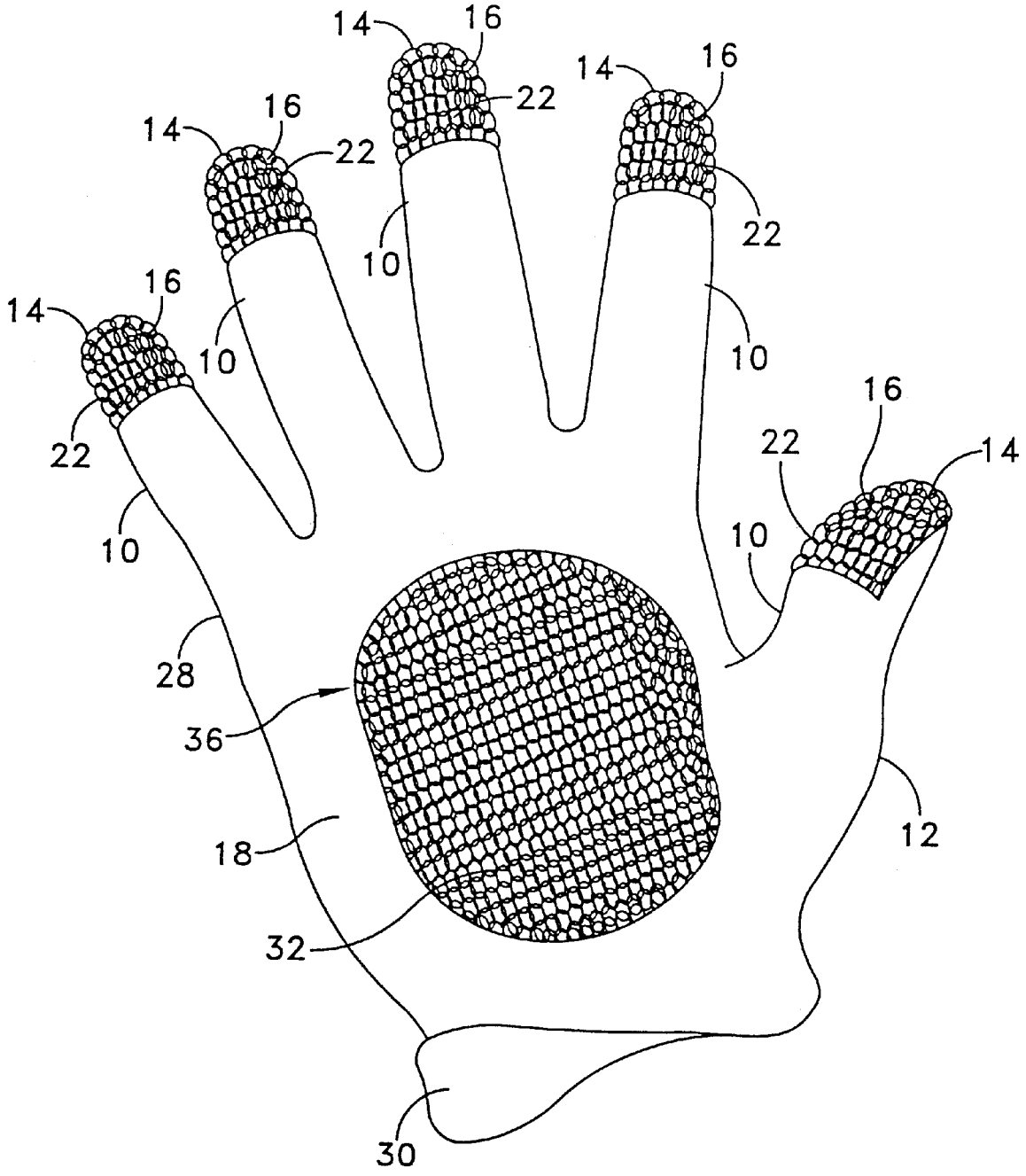
FIG. 1 is a substantially plan view of a palm side of one form of glove illustrative of an embodiment of the invention.

Referring to FIG. 1, it will be seen that the illustrative glove includes five finger portions 10. For purposes of description herein, the glove thumb portion 12 is included as a finger portion 10. A finger tip portion 14 of a plurality of the finger portions 10 are of a wire mesh material 16, preferably of stainless steel wire.

Figure 2:
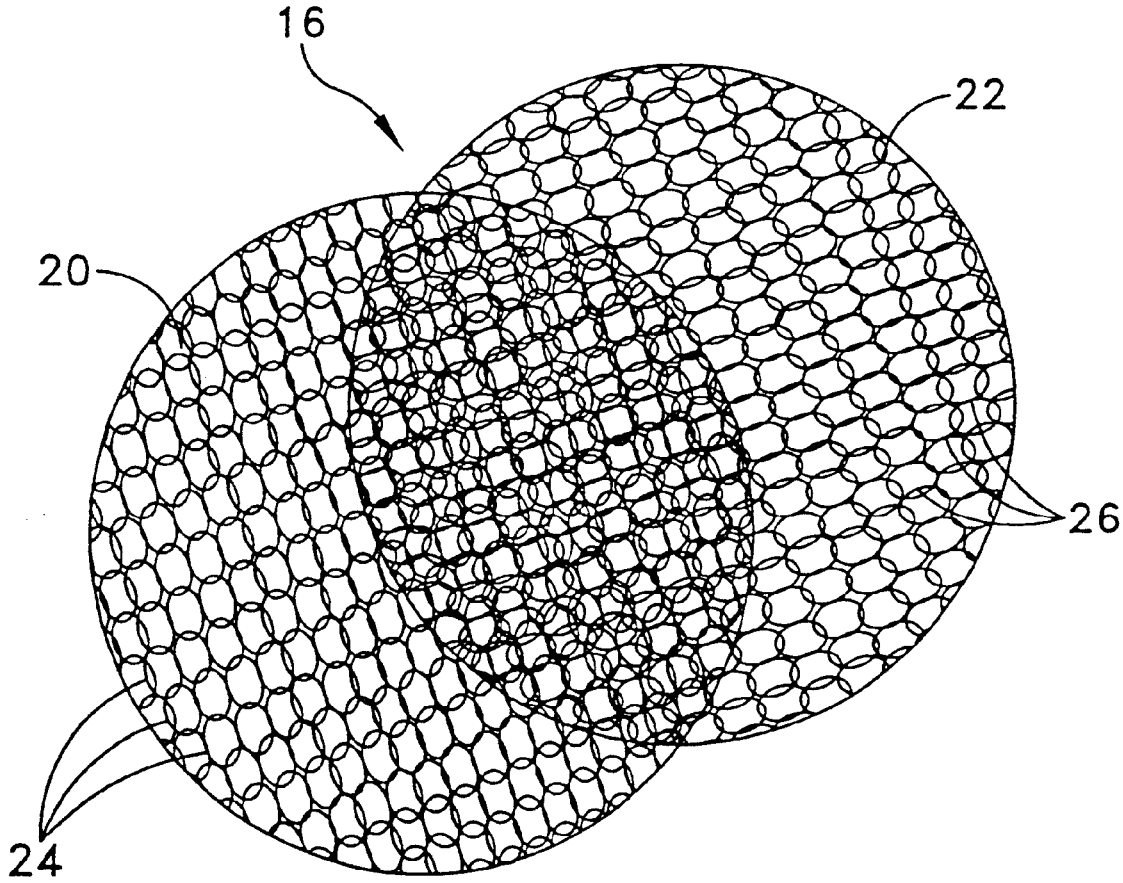
FIG. 2 is a diagrammatic enlarged view showing the overlay of two sheets of mesh material.
Figure 2B:
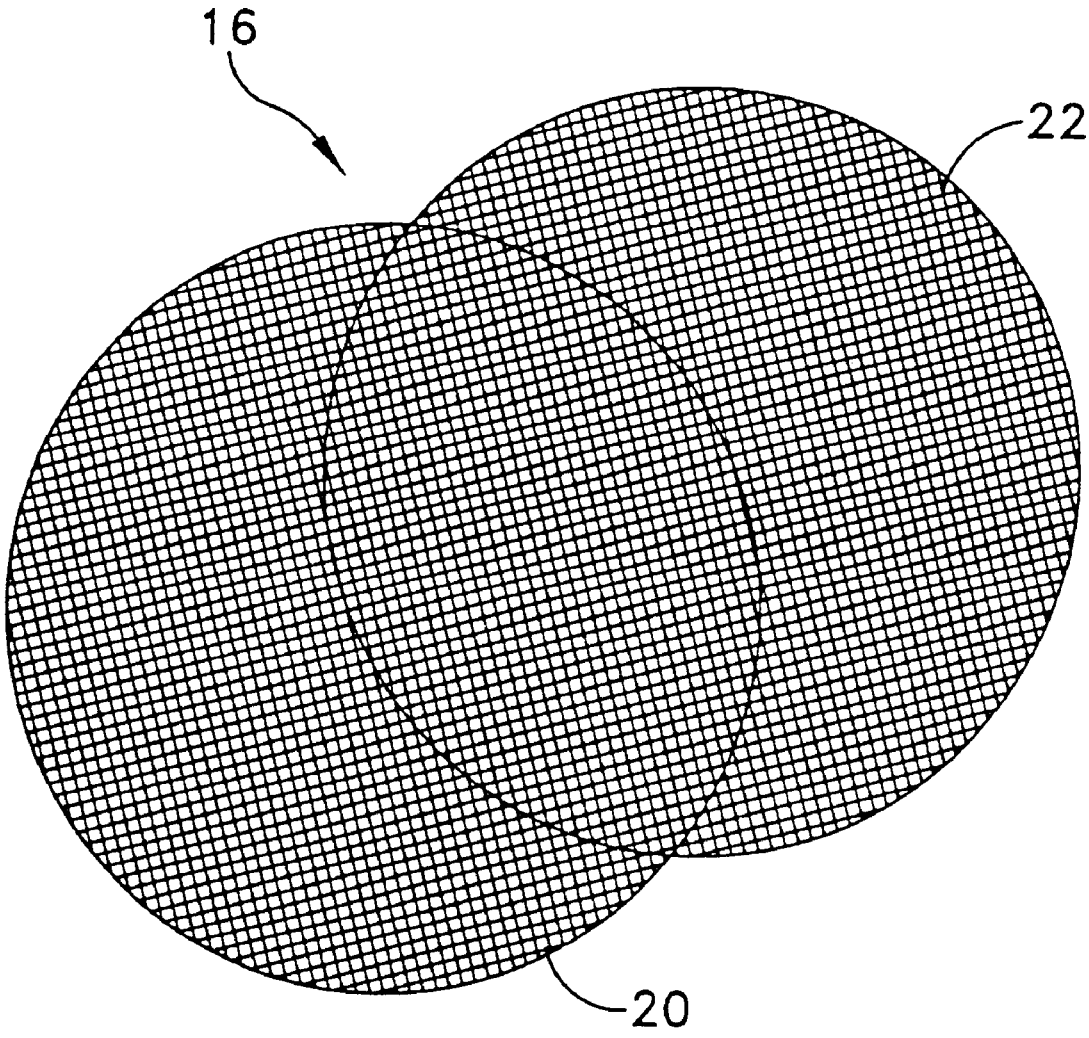
FIG. 2B is similar to FIG. 2, but illustrative of an alternative embodiment.

The wire mesh material 16 preferably is disposed on a palm side 18 of the glove and includes two layers 20, 22 of wire mesh material (FIGS. 2 and 2B). The layers 20, 22 are off-set in such a manner that interstices of strands form openings 24, 26 (FIG. 2) off-set from each other. The two layers 20,22 provide protection from needles, reducing substantially the possibility of needle penetration at various angles. Inasmuch as the mesh openings are minuscule when two layers are combined, a typical hypodermic needle pushed into the mesh is too thick in gauge to fit through the openings.

The wire mesh material 16 preferably comprises woven stainless steel wire of about 0.003 inch in diameter. Each layer of wire mesh is provided with about 325 holes per square inch.

Aside from the mesh portions, the glove 28 preferably is selected from leather, natural fabrics, synthetic fabrics, blended fabrics, chain-mail, plastics, and composites. When leather is selected, it is preferabl that the leather be (1) a full grain deerskin having a weight of about 1½–2 ounces per square yard; or (2) a chrome tanned sheepskin having a weight of about 1½–2¼ ounces per square yard; or (3) a chrome tanned dry-soft water and oil resistant goatskin from green hides and salted hides, and having a weight of about 2±0.025 ounces per square yard.

The selected leather material and the stainless steel mesh portions are sewn together by a filament nylon thread or a stainless steel fine filament thread. The glove is provided with a liner 30 (FIG. 1) of a natural or synthetic cut resistant fiber or fiber blend. The edges of wire mesh parts may be covered with seam tape binding prior to stitching, to maintain smooth seam allowances. Alternatively, adhesive may be applied along rough edges.

Figure 1B:
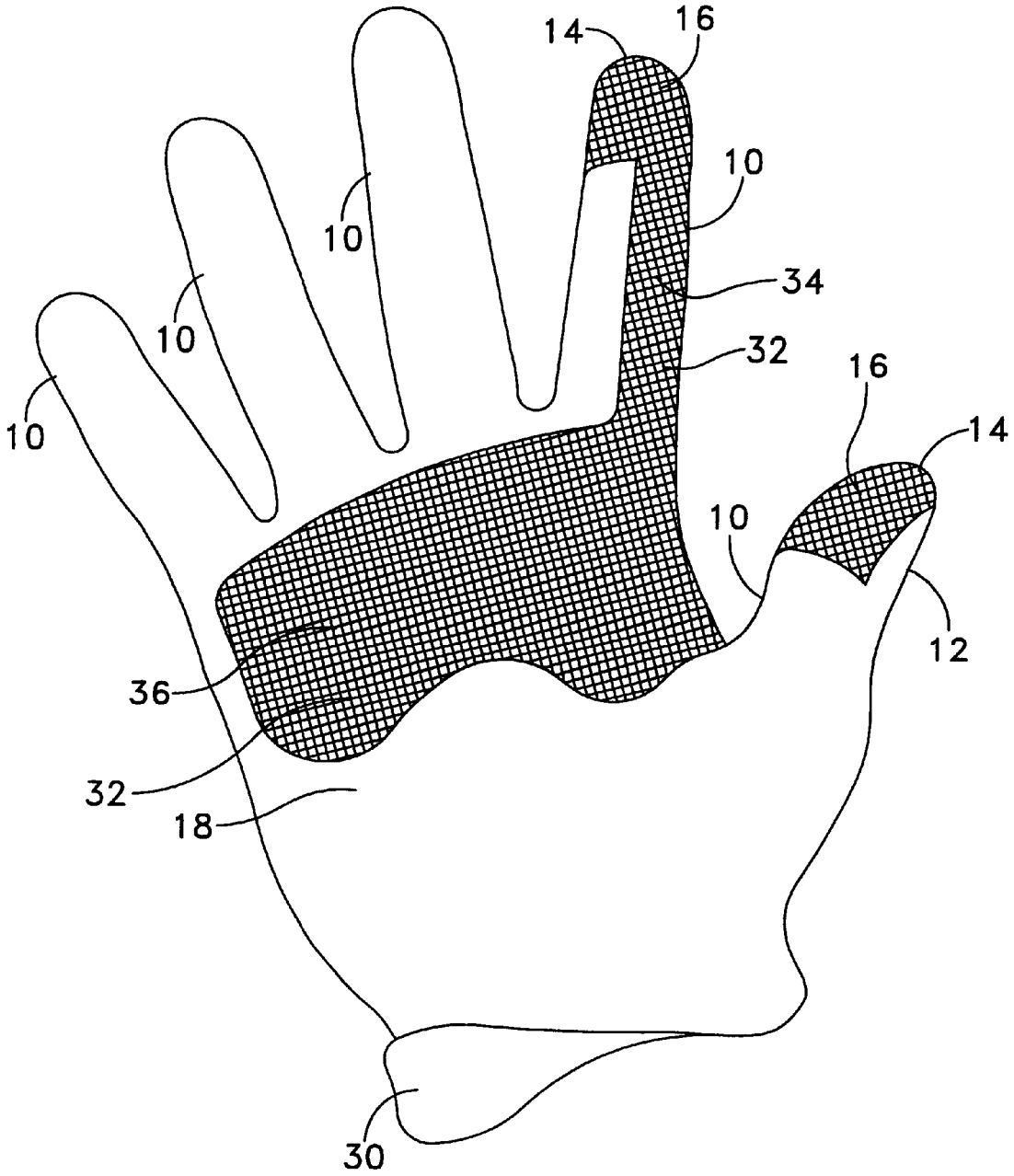
FIG. 1B is similar to FIG. 1, but illustrative of an alternative embodiment.
Figure 3:
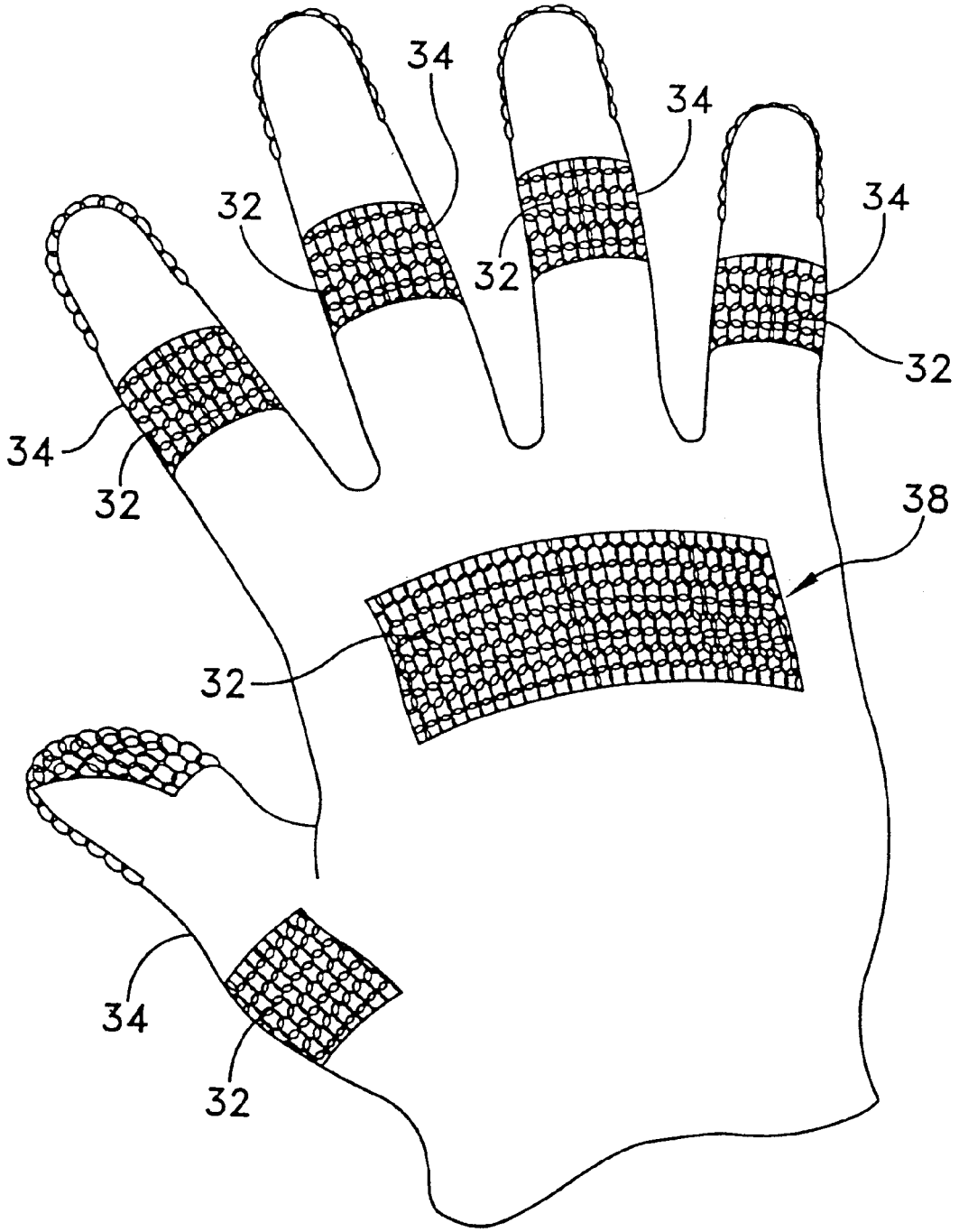
FIG. 3 is similar to FIG. 1, but showning a back hand side of the glove and illustrative of further alternative embodiments.

Depending upon the intended use for the glove, additional stainless steel mesh portions 32 may be disposed on further finger portions 34 (FIGS. 1B and 3), palm portions 36 (FIGS. 1 and 1B), and back hand portions 38 (FIG. 3).

The glove is patterned to "fit like a glove". That is, the finished glove dimensions are patterned to include only the necessary range of ease (space between the skin and glove). The glove is patterned without excess ease, in order to eliminate baggy areas that do not conform to the hand. This is accomplished using good standard commercial leather glove patterning practice with the selection of good quality leather skins, and by careful attention, time, and manual care to prepare the leather correctly prior to stitching by either "pattern" or "table" cut methods. Initial inspection of the leather skins will eliminate areas that are weak (such as flank pockets), or have uneven thickness, contain wrinkles, loose, spongy, or boardy leather. Also, areas that are not soft and pliable, have grain cracked, peeled, or abraded, cuts, holes, scars, scratches, brittle areas, or bony areas are eliminated. The leather skins are dampened, stretched, and cut by hand, or die cut. All of the stretch in the lengthwise direction is pulled out prior to cutting. Any areas of the skins that contain hard spots after stretching are eliminated. Tranks, the cut leather parts, are cut so that the stretch is in the width direction of the assembled glove. The cut leather parts that stretch lengthwise are not used in the gloves. Dies are "struck through", uniformly penetrating from grain side through to the flesh side. Leathers are treated for perspiration resistance.

The estimated quantity of leather used for a single pair of gloves is 2.35 $ft^2$.

There is thus provided a glove which provides protection from punctures and cuts during frisk and pat-down searches. The low-bulk, close-fitting glove described herein, while affording the aforementioned protection, allows for good tactile sensation. The wearer is able to perceive what is touched. Beyond the wire mesh portions, the glove material permits comfortable bending, flexing, and twisting motions of the hand.

It is to be understood that the present invention is by no means limited to the particular construction herein disclosed and/or shown in the drawings, but also comprises any modification or equivalent within the scope of the claims.

What is claimed is:

1. A protective glove for a human hand, the glove comprising:

five finger portions; and a finger tip portion of a plurality of said finger portions comprising wire mesh;

wherein said wire mesh includes woven metal wire of about 0.003 inch diameter and said wire mesh is provided with about 325 holes $in/^2$;

wherein said wire mesh includes two layers of the woven metal wire; and wherein the two layers of woven metal wire are off-set such that interstices of one of the layers is off-set from interstices of the other layer.

2. The glove in accordance with claim 1 wherein said wire mesh is stainless steel.

3. The glove in accordance with claim 2 wherein said two layers of stainless steel are disposed on a palm side of said plurality of finger portions.

4. The glove in accordance with claim 2 wherein the glove outer surface other than said finger tip portion is of a leather material selected from a group of leather materials consisting of (1) full grain deerskin having a weight of 1½–2 ounces/$yd^2$, (2) chrome tanned sheepskin having a weight of 1½–2¼ ounces/$yd^2$, and (3) chrome tanned dry-soft water and oil resistant goatskin, from green hides and salted hides, and having a weight of 2 ounces±0.025 ounces/$yd^2$.

5. The glove in accordance with claim 4 wherein the glove is stretchable widthwise but not lengthwise.

6. The glove in accordance with claim 4 wherein the selected leather material and the stainless steel mesh are sewn together by a selected one of filament nylon thread and stainless steel fine filament thread.

7. The glove in accordance with claim 1 wherein said wire mesh is disposed on a palm side of said plurality of finger portions.

8. The glove in accordance with claim 1 wherein said wire mesh comprises two layers of wire mesh and both layers are of stainless steel.

9. The glove in accordance with claim 8 wherein said two layers of stainless steel wire mesh are disposed on a palm side of said plurality of finger portions.

10. The glove in accordance with claim 1 wherein the metal wire is stainless steel.

11. The glove in accordance with claim 1 wherein:

said wire is stainless steel; and a remainder of an outer surface of the glove is of a material selected from a group of materials consisting of leathers, natural fabrics, synthetic fabrics, blended fabrics, chain-mail, plastics, and composites.

12. The glove in accordance with claim 11 wherein the glove further comprises a liner of a natural and synthetic fiber blend, the blend being cut-resistant.

13. The glove in accordance with claim 1 wherein a further portion of the glove comprises wire mesh, said further portion comprising at least one of further finger portions, a palm portion, and a back hand portion.

14. A protective glove for a human hand, the glove comprising:

five finger portions; and a finger tip portion of a plurality of said finger portions comprising wire mesh; wherein said wire mesh is stainless steel;

wherein the glove outer surface other than said finger tip portion is of a leather material selected from a group of leather materials consisting of (1) full grain deerskin having a weight of 1½–2 ounces/$yd^2$, (2) chrome tanned sheepskin having a weight of 1½–2¼ ounces/$yd^2$, and (3) chrome tanned dry-soft water and oil resistant goatskin, from green hides and salted hides, and having a weight of 2 ounces±0.025 ounces/$yd^2$; and wherein the selected leather material and the stainless steel mesh are sewn together by a selected one of filament nylon thread and stainless steel fine filament thread.

15. The glove in accordance with claim 14 wherein said wire mesh comprises two layers of wire mesh.

16. The glove in accordance with claim 15 wherein said two layers of stainless steel are disposed on a palm side of said plurality of finger portions.

17. The glove in accordance with claim 14 wherein said wire mesh is disposed on a palm side of said plurality of finger portions.

18. The glove in accordance with claim 14 herein said wire mesh comprises two layers of wire mesh and both layers are of stainless steel.

19. The glove in accordance with claim 18 wherein said two layers of stainless steel wire mesh are disposed on a palm side of said plurality of finger portions.

20. The glove in accordance with claim 14 wherein said wire mesh includes woven metal wire of about 0.003 inch diameter and said wire mesh is provided with about 325 holes/$in^2$.

21.The glove in accordance with claim 20 wherein said wire mesh includes two layers of the woven metal wire.

22. The glove in accordance with claim 21 wherein the two layers of woven metal wire are off-set such that interstices of one of the layers is off-set from interstices of the other layer.

23. The glove in accordance with claim 14 wherein the glove is stretchable widthwise but not lengthwise.

24. The glove in accordance with claim 14 wherein a further portion of the glove comprises wire mesh, said further portion comprising at least one of further finger portions, a palm portion, and a back hand portion.

25. The glove in accordance with claim 24 wherein said wire mesh comprises two layers of wire mesh.

26. A protective glove for a human hand, the glove comprising:

five finger portions; and a finger tip portion of a plurality of said finger portions comprising wire mesh; wherein said wire mesh is stainless steel, and a remainder of an outer surface of the glove is of material selected from A group of materials consisting of leathers, natural fabrics, synthetic fabrics, blended fabrics, chain-mail, plastics, and composites; and wherein the glove further comprises a liner of a natural and synthetic fiber blend, the blend being cut-resistant.

27. The glove in accordance with claim 26 wherein said wire mesh comprises two layers of wire mesh.

28. The glove in accordance with claim 27 wherein said two layers of stainless steel are disposed on a palm side of said plurality of finger portions.

29. The glove in accordance with claim 26 wherein said wire mesh is disposed on a palm side of said plurality of finger portions.

30. The glove in accordance with claim 26 wherein said wire mesh comprises two layers of wire mesh and both layers are of stainless steel.

31. The glove in accordance with claim 30 wherein said two layers of stainless steel wire mesh are disposed on a palm side of said plurality of finger portions.

32. The glove in accordance with claim 26 wherein said wire mesh includes woven metal wire of about 0.003 inch diameter and said wire mesh is provided with about 325 holes/in$^2$.

33. The glove in accordance with claim 32 wherein said wire mesh includes two layers of the woven metal wire.

34. The glove in accordance with claim 33 wherein the two layers of woven metal wire are off-set such that interstices of one of the layers is off-set from interstices of the other layer.

35. The glove in accordance with claim 26 wherein the glove outer surface other than said finger tip portion is of a leather material selected from of group of leather materials consisting of (1) full grain deerskin having a weight of 1½–2 ounces/yd$^2$ , (2) chrome tanned sheepskin having a weight of 1½ –2 ¼ ounces/yd$^2$, and (3) chrome tanned dry-soft water and oil resistant goatskin, from green hides and salted hides, and having a weight of 2 ounces±0.025 ounces/yd$^2$.

36. The glove in accordance with claim 35 wherein the glove is stretchable widthwise but not lengthwise.

37. The glove in accordance with claim 35 wherein the selected leather material and the stainless steel mesh are sewn together by a selected one of filament nylon thread and stainless steel fine filament thread.

38. The glove in accordance with claim 20 wherein a further portion of the glove comprises wire mesh, said further portion comprising at least one of further finger portions, a palm portion, and a back hand portion.

39. The glove in accordance with claim 38 wherein said wire mesh comprises two layers of wire mesh.

* * * * *